US006785645B2

(12) United States Patent
Khalil et al.

(10) Patent No.: US 6,785,645 B2
(45) Date of Patent: Aug. 31, 2004

(54) REAL-TIME SPEECH AND MUSIC CLASSIFIER

(75) Inventors: Hosam Adel Khalil, Bellevue, WA (US); Vladimir Cuperman, Goleta, CA (US); Tian Wang, Goleta, CA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 09/997,679

(22) Filed: Nov. 29, 2001

(65) Prior Publication Data

US 2003/0101050 A1 May 29, 2003

(51) Int. Cl.[7] ..... G10L 19/00; G10L 9/14; G10H 7/00

(52) U.S. Cl. ..... 704/216; 704/219; 704/500

(58) Field of Search ..... 704/503, 501, 704/500, 270, 268, 267, 266, 265, 233, 223, 214, 216, 203

(56) References Cited

U.S. PATENT DOCUMENTS

| | | | | |
|---|---|---|---|---|
| 5,394,473 A | | 2/1995 | Davidson | |
| 5,717,823 A | | 2/1998 | Kleijn | |
| 5,734,789 A | | 3/1998 | Swaminathan et al. | |
| 5,751,903 A | | 5/1998 | Swaminathan et al. | |
| 5,778,335 A | * | 7/1998 | Ubale et al. | 704/219 |
| 6,108,626 A | | 8/2000 | Cellario et al. | |
| 6,134,518 A | * | 10/2000 | Cohen et al. | 704/201 |
| 6,240,387 B1 | | 5/2001 | DeJaco | |
| 6,310,915 B1 | | 10/2001 | Wells et al. | |
| 6,311,154 B1 | | 10/2001 | Gersho et al. | |
| 2001/0023395 A1 | | 9/2001 | Su et al. | |

FOREIGN PATENT DOCUMENTS

WO WO 9827543 * 6/1998 ..... G10L/11/02

OTHER PUBLICATIONS

Bessette et al., "A wideband speech and audio codec at 16/24/32 kbit/s using hybrid ACELP/TCX techniques," Jun. 1999, Proceeding of IEEE Workshop on Speech Coding, Poorvoo Finland, pp. 7–9.*

Combescure et al., "A 16, 24, 32 kbit/s wideband speech codec based on ATCELP," Mar. 1999, Proceedings of IEEE International Conference on Acoustics, Speech, and Signal Processing, vol. 1, pp. 15–19.*

Ellis et al., "Speech/music discrimination based on posterior probability features," Proceedings of Eurospeech, 1999, Budapest.*

El–Maleh et al., "Speech/music discrimination for multimedia applications," Proceedings of IEEE International Conference on Acoustics, Speech, and Signal Processing, vol. 4, pp 2445–2448.*

(List continued on next page.)

*Primary Examiner*—Richemond Dorvil
*Assistant Examiner*—V. Paul Harper
(74) *Attorney, Agent, or Firm*—Leydig, Voit & Mayer, Ltd.

(57) ABSTRACT

An efficient and accurate classification method for classifying speech and music signals, or other diverse signal types, is provided. The method and system are especially, although not exclusively, suited for use in real-time applications. Long-term and short-term features are extracted relative to each frame, whereby short-term features are used to detect a potential switching point at which to switch a coder operating mode, and long-term features are used to classify each frame and validate the potential switch at the potential switch point according to the classification and a predefined criterion.

17 Claims, 12 Drawing Sheets

OTHER PUBLICATIONS

Saunders "Real–time discrimination of broadcase speech/music," May 1996, Proceedings of IEEE International Conference on Acoustics, Speech, and Signal Processing, vol. 2, pp 993–996.*

Scheirer "Construction and evaluation of a robust mutifeature speech/music discriminator," IEEE International Conference on Acoustics, Speech, and Signal Processing, vol. 2, pp. 1331–1334.*

Tancerel "Combined speech and audio coding by discrimination, Sep. 2000," IEEE Workshop on Speech Coding, pp. 154–156.*

Russell et al. "Artificial Intelligence: A Modern Approach," 1995, Prentice Hall, NJ, pp. 567–570.*

Houtgast, T., et al., "The Modulation Transfer Function in Room Acoustics as a Predictor of Speech Intelligibility," *Acustica*, vol. 23, pp. 66–73 (1973).

Tzanetakis, G., et al., "Multifeature Audio Segmentation for Browsing and Annotation," *In Proceedings of the 1999. IEEE Workshop on Applications of Signal Processing to Audio and Acoustics*, New Paltz, NY, pp. 103–103 (Oct. 1999).

Schnitzler, J., et al., "Wideband Speech Coding Using Forward/Backward Adaptive Prediction with Mixed Time/Frequency Domain Excitation," *1999 IEEE Workshop on Speech Coding Proceedings* (*Model,Coders, and Error Criteria*), Provoo, Finland, pp. 4–6 (Jun. 1999).

Ramprashad, Sean A., "A Multimode Transform Predictive Coder (MTPC) for Speech and Audio," *Proc. IEEE Workshop on Speech Coding*, pp. 10–12 (1999).

Chen, J–H, et al., "Transform Predictive Coding of Wideband Speech Signals," *Proc. International Conference on Acoustic, Speech, Signal Processing*, pp. 275–278 (1996).

Ubale, A, et al., "A Multi–Band CELP Wideband Speech Coder," *1997 IEEE International Conference on Acoustics, Speech and Signal Processing*, vol. II of V, *Speech Processing*, pp. 1367–1370 (Apr. 1997).

Tancerel, L., "Combined Speech and Audio Coding by Discrimination," *In Proceedings of IEEE Workshop on Speech Coding*, pp. 154–156, (2000).

Combescure, P., et al., "A 16, 24, 32 kbit/s Wideband Speech Codec Based on ATCELP," *In Proceedings of IEEE International Conference on Acoustics, Speech, and Signal Processing*, vol. 1, pp. 5–8 (Mar. 1999).

Lefebvre, R., et al., "High Quality Coding of Wideband Audio Signals Using Transform Coed Excitation (TCX)", *In Proceedings IEEE International Conference Acoustics, Speech, and Signal Processing*, vol. 1, pp. I/193–I/196.

ITU–T, G.722.1, "Series G: Transmission Systems and Media Networks", Coding at 24 and 32 kbits/s for hands–free operation in systems with low frame loss, (09/99) pp. 1–21.

Salami, et al., "A Wideband Codec at 16/24 kbits with 10 ms Frames," Sep. 1997, *In Proceedings of IEEE Workshop on Speech Coding for Telecommunications*, pp. 103–104 (1997).

* cited by examiner

REAL-TIME SPEECH AND MUSIC CLASSIFIER

FIELD OF THE INVENTION

This invention is related, in general, to digital signal processing, and more particularly, to a method and a system of classifying different signal types in multi-mode coding systems.

BACKGROUND OF THE INVENTION

In current multimedia applications such as Internet telephony, audio signals are composed of both speech and music signals. However, designing an optimal universal coding system capable of coding both speech and music signals has proven difficult. One of the difficulties arises from the fact that speech and music are essentially represented by very different signals, resulting in the use of disparate coding technologies for these two signal modes. Typical speech coding technology is dominated by model-based approaches such as Code Excited Linear Prediction (CELP) and Sinusoidal Coding, while typical music coding technology is dominated by transform coding techniques such as Modified Lapped Transformation (MLT) used together with perceptual noise masking. These coding systems are optimized for the different signal types respectively. For example, linear prediction-based techniques such as CELP can deliver high quality reproduction for speech signals, but yield unacceptable quality for the reproduction of music signals. Conversely, the transform coding-based techniques provide excellent quality reproduction for music signals, but the output degrades significantly for speech signals, especially in low bit-rate regimes.

In order to accommodate audio streams of mixed data types, a multi-mode coder that can accommodate both speech and music signals is desirable. There have been a number of attempts to create such a coder. For example, the Hybrid ACELP/Transform Coding Excitation coder and the Multi-mode Transform Predictive Coder (MTPC) are usable to some extent to code mixed audio signals. However, the effectiveness of such hybrid coding systems depends upon accurate classification of the input speech and music signals to adjust the coding mode of the coder appropriately. Such a functional module is referred to as a speech-and-music classifier (hereafter, "classifier").

In operation, a classifier is initially set to either a speech mode, or a music mode, depending on historical input statistics. Thereafter, upon receiving a sequence of music and speech signals, the classifier classifies the input signal during a particular interval as music or speech, whereupon the coding system is left in, or switched to, the appropriate mode corresponding to the determination of the classifier. While switching of modes in the coder is necessary and desirable when the need to do so is indicated by the classifier, there are disadvantages to switching too readily. Every instance of switching carries with it the possibility of introducing audible artifacts into the reproduced audio signal, degrading the perceived performance of the coder. Unfortunately, prior classification techniques do not provide an efficient solution for avoiding unnecessary switching.

Most current speech/music classifiers are essentially based on classical pattern recognition techniques, including a general technique of feature extraction followed by classification. Such techniques include those described by Ludovic Tancerel et al, in "Combined Speech and Audio Coding by Discrimination," page 154, Proc. IEEE Workshop on Speech Coding (September 2000), and by Eric Scheirer et al., in "Construction and Evaluation of a Robust Multi-feature Speech/Music Discriminator", Proc. IEEE Int'l Conference Acoustics, Speech, and Signal Processing, page 1331 (April 1997).

Since speech and music signals are intrinsically different, they present disparate signal features, which in turn, may be utilized to discriminate music and speech signals. Examples of prior classification frameworks include Gaussian mixture model, Gaussian model classification and nearest-neighbor classification. These classification frameworks use statistical analyses of underlying features of the audio signal, either in a long or short period of measurement time, resulting in separate long-term and short-term features.

Use of either of these feature sets exclusively presents certain difficulties. For a method based on analysis of long-term features, classification requires a relatively longer measurement period of time. Even though this will likely yield reasonably accurate classification for a frame, long-term features do not allow for a precise localization in time of the switching point between different modes. On the other hand, a method based on analysis of short-term features may provide rapid switching response to frames, but its classification of a frame may not be as accurate as a classification based on a larger sampling.

SUMMARY OF THE INVENTION

The present invention provides an accurate and efficient classification method for use in a multi-mode coder encoding a sequence of speech and music frames for classifying the frames and switching the coder into speech or music mode pursuant to the frame classification as appropriate. The method is especially advantageous for real-time applications such as teleconferencing, interactive network services, and media streaming. In addition to classifying signals as speech or music, the present invention is also usable for classifying signals into more than two signal types. For example, it can be used to classify a signal as speech, music, mixed speech and music, noise, and so on. Thus, although the examples herein focus on the classification of a signal as either speech or music, the invention is not intended to be limited to the examples.

To efficiently and accurately discriminate speech and music frames in a mixed audio signal, a set of features, each of which properly characterizes an essential feature of the signal and presents distinct values for music and speech signals, are selected and extracted from each received frame. Some of the selected features are obtained from the signal spectrum in the frequency domain, while others of the selected features are extracted from the signals in the time domain. Furthermore, some of the selected features utilize variance values to describe the statistical properties of a group of frames.

For each of the frames, long-term and short-term features are estimated. The short-term features are utilized to accurately determine a possible switching time for the coder, while the long-term features are used to accurately classify the frames on a frame-by-frame basis. A predefined switching criterion is applied in determining whether to switch the operation mode of the coder. The predefined switching criterion is defined at least in part, to avoid unexpected and unnecessary switching of the coder, since as discussed above, this may introduce artifacts that audibly degrade the reproduction signal quality.

According to an embodiment, the input sequence of music and speech signals is recorded in a look-ahead buffer followed by a feature extractor. The feature extractor extracts a set of long-term and short-term features from each frame in the buffer. The long-term features and short-term features are then provided to a classification module that first detects a potential switching time according to the short-term features of the current coding frame and the current coding mode of the coder, and then classifies each frame according to the long-term features, and determines whether to switch the operation mode of the coder for the classified frame at the potential switching time according to a predefined switch criterion.

In one embodiment of the invention, the classification for each frame is accomplished by applying a decision tree method with each decision node evaluating a specific selected feature. By comparing the value of the feature with the threshold defined by the node, the decision is propagated down the tree until all the features are evaluated, and a classification decision is thus made. Such a classified frame is then used, in conjunction with one or more frames following it in most cases, in determining whether to switch the operation mode of the coder based on a predefined switching criterion.

The switching criterion employs a plurality of overlapping switching-test windows, in each of which the number of the frames of each class is counted and the counted numbers are statistically analyzed. If the statistically analyzed number is higher than a predefined threshold, and the class associated with the number is different from the on-going operation mode of the coder, a switching indication is made in that switching-test window. The criterion preferably defines that only when all of the switching-test windows present indications of a switch is a switching decision sent to the coder. In this way, excessive switching caused by random signals or noise signals may be avoided. In an embodiment, the switching criterion employs a single switching-test window.

In another embodiment of the invention, the classification is accomplished with the aid of a likelihood function determined by the selected features for evaluating the frames. Provided that the features of the frames substantially comply with a Gaussian distribution, a distance measure such as the Mahalanobis distance from the classes of a frame are calculated in this embodiment. The distances are then entered into the likelihood function for each frame. In this way, a collective likelihood profile of all frames in the buffer may be obtained. Then the subsequent classification of a frame may be accomplished based on the likelihood profile. This embodiment is similar to the previously described embodiment in that the switching decision is made according to the predefined criterion and the switching time is determined through the use of the short-term features extracted from the frame.

According to an embodiment of the invention, the classification information for each frame is preferably attached or otherwise immediately associated with the classified frame. Alternatively, the classification information may be transmitted separately from the encoded frames.

For a multi-mode decoder on the receiving side, having at least speech decoding and music decoding modes, a decoder of classification information in connection with the decoder is provided for directing the decoder operation in keeping with the classification information.

BRIEF DESCRIPTION OF THE DRAWINGS

While the appended claims set forth the features of the present invention with particularity, the invention, together with its objects and advantages, may be best understood from the following detailed description taken in conjunction with the accompanying drawings of which:

DETAILED DESCRIPTION OF THE INVENTION

Figure 1:
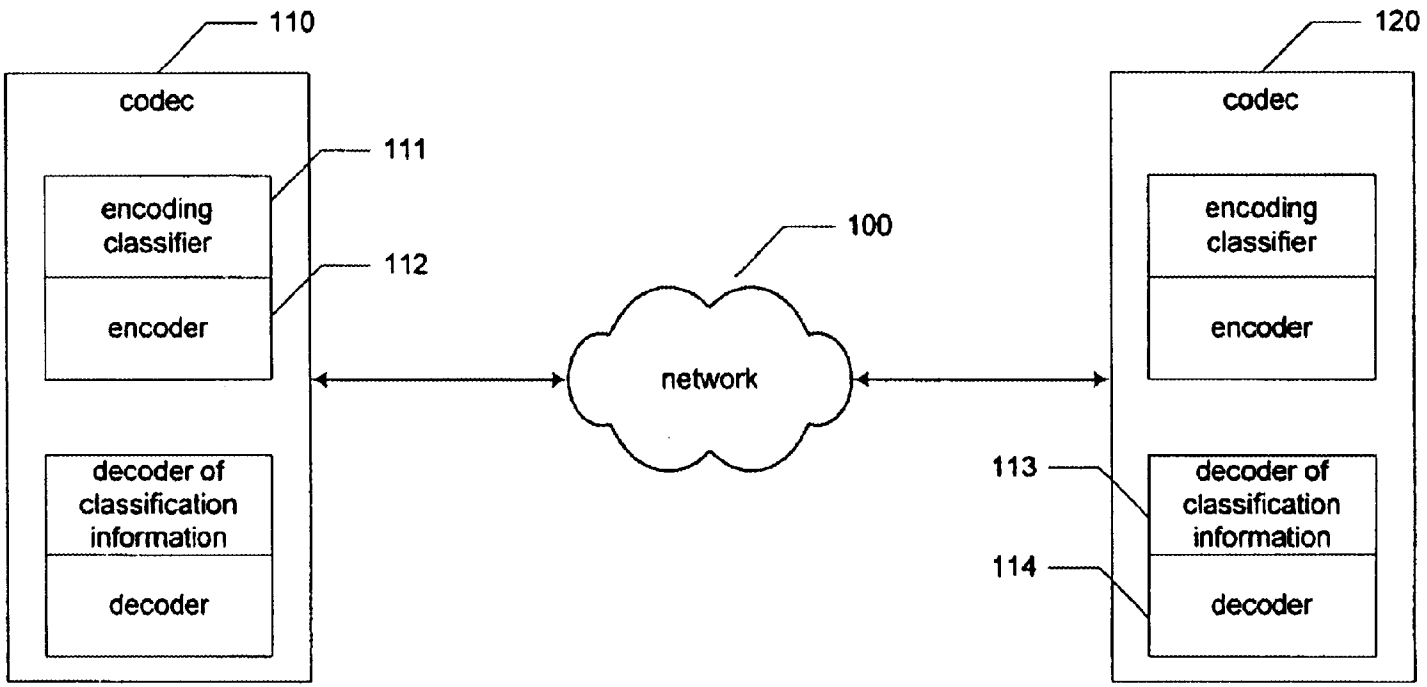
FIG. 1 illustrates exemplary network-linked hybrid speech/music codec modules according to an embodiment of the invention.

The present invention provides a classification method and system usable in conjunction with a multi-mode coder coding a sequence of speech and music frames, from each of which long-term and short-term features are extracted. Long-term features are used to classify the frames and short-term features are utilized to determine the switching time in the sequence of frames.

An exemplary hybrid speech and music codec environment within which an embodiment of the invention may be implemented is described with reference to FIG. 1. The illustrated environment comprises codecs 110, 120 communicating with one another over a network 100, illustrated as a cloud. Network 100 may include many well-known components, such as routers, gateways, hubs, etc. and provides communications via either or both of wired and wireless media. Each codec comprises at least an encoding classifier 111, an encoder 112, a decoder of classification information 113 and a decoder 114. Although the communication between codecs is illustrated as bi-directional, the invention may be used in a unidirectional manner over a transmission medium and may also be used in a local rather than networked environment.

Encoder 112 encodes audio signals for transmission over networks or other transmission facilities. The encoder 112 operates in multiple modes to accommodate multiple signal types. For example, a speech mode is utilized to code speech signals while a music mode is utilized to code music signals. In order to use the benefits provided by the multi-mode operations of encoder 112, input audio signals composed of speech and music signals are classified prior to encoding. This classification is accomplished by encoding classifier 111 that provides an output to encoder 112.

The classification information, i.e. whether a particular signal interval contains speech or music data, may be attached to the classified signal and transmitted to the network after encoding. Alternatively, the classification information may be transmitted separately from the encoded signal.

Such classification information is preferably used in turn, to decode the encoded signals at the receiver. For example, decoder 114 preferably has multiple decoding modes comprising at least a speech mode and a music mode. Upon receiving a sequence of encoded signals and associated classification information from network 100, decoder of classification information 113 extracts the classification information from the received signals and uses that information to direct the decoder to enter or remain in the appropriate mode of operation.

Figure 2:
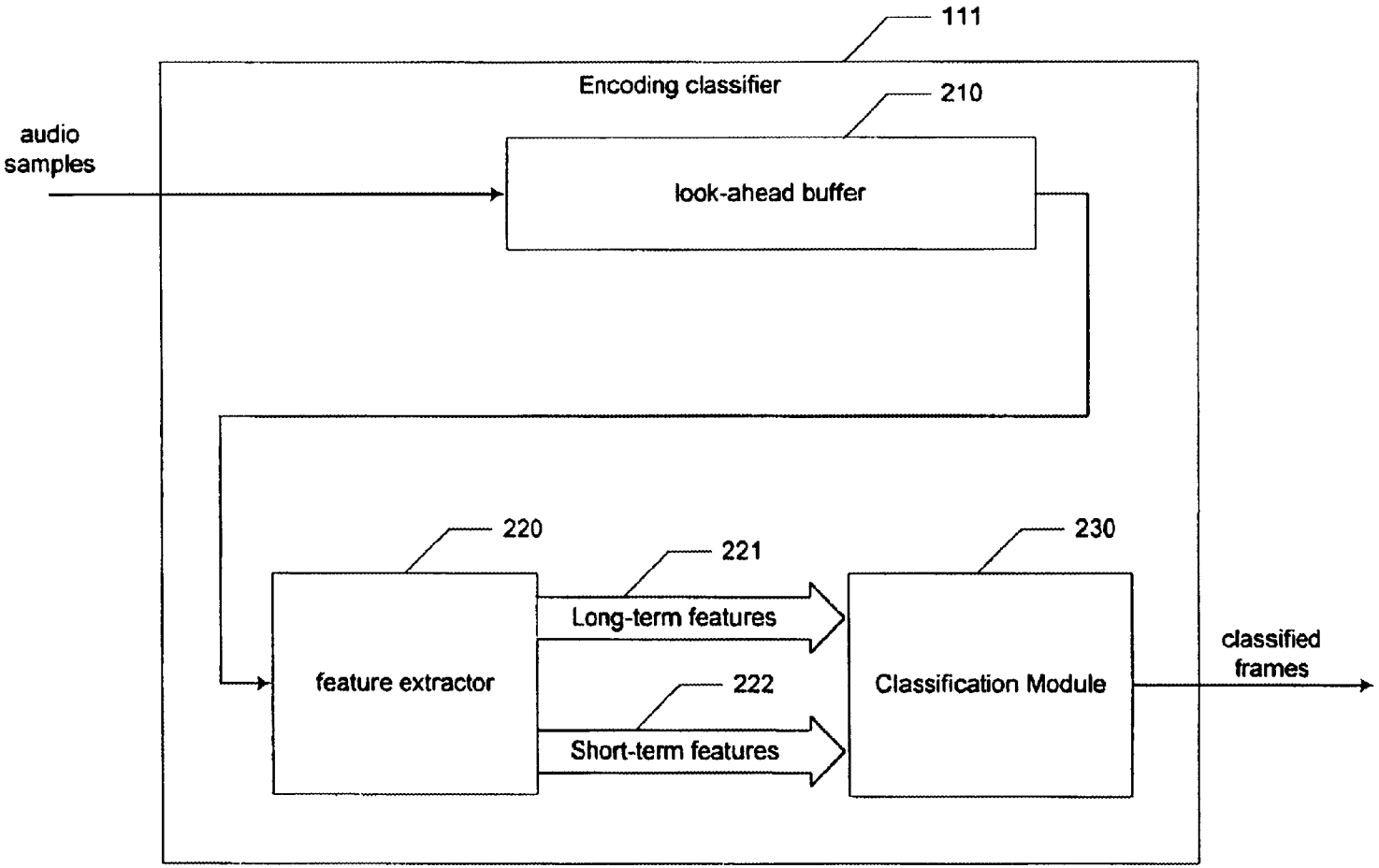
FIG. 2 illustrates an architectural diagram showing an encoding classifier according to an embodiment of the invention.

Referring to FIG. 2, a block diagram of the basic structure of encoding classifier 111 in FIG. 1 is illustrated. Encoding classifier 111 comprises a look-ahead buffer 210, a feature extractor 220 that produces long-term features 221 and short-term features 222, and a classification module 230 for use in connection with feature extractor 220.

In an embodiment of the invention, the received input audio signals are recorded in look-ahead buffer 210 as a sequence of audio frames, each of which may be composed of a plurality of signals having a plurality of signal types. The frames in the buffer sequentially flow into feature extractor 220, wherein a set of selected features is calculated for each frame.

Feature extractor 220 provides at least a set of long-term features 221 and a set of short-term features 222 to classification module 230. According to an embodiment, the short-term features are used to determine a potential switching point and the long-term features are then used to more precisely determine whether to switch at that point by classifying the audio frames and validating the detected potential switch according to a predefined switching criterion. The operation mode of the encoder is thus decided by the determination result. The classified frames output from classification module 230 may then be encoded by encoder 112.

Figure 3:
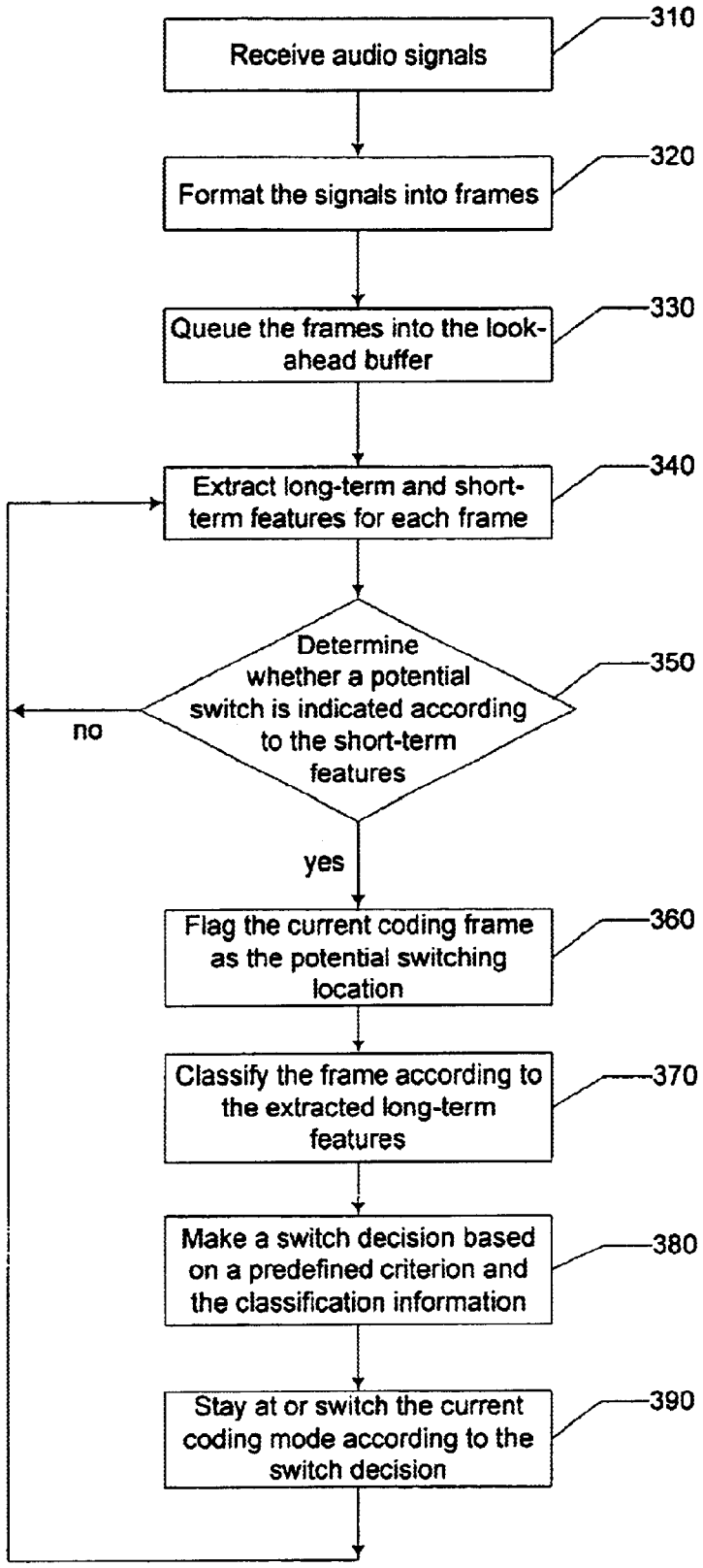
FIG. 3 is a flow chart demonstrating the steps executed in classifying a sequence of music and speech signals according to an embodiment of the invention.

Referring to FIG. 3, a flow chart illustrates the steps executed in performing the method described with reference to FIG. 2. Starting at step 310, audio signals are received. The signals are then formatted into frames at step 320 and queued in the look-ahead buffer at step 330. For each of the recorded frames, a set of long-term and a set of short-term features are extracted at step 340. Subsequently at step 350, it is determined whether a potential switch is indicated according to the short-term features of the current coding frame and the current coding mode. If step 350 yields a "yes", the method proceeds to step 360 wherein the current frame is flagged as the potential switching location. Otherwise, the process flow loops back to step 340 for analysis of a subsequent frame. Following step 360, steps 370 and 380 are used to determine whether to switch the current operation mode of the encoder. In particular, at step 370 the frame is classified according to the extracted long-term features, and the frame classification is used in step 380 to determine whether to switch the current operation mode of the coder based on a predefined criterion. At step 390, the encoder either stays in or switches its current operation mode in accordance with the switching decision of step 380 for the frame, and the process loops back to step 340 for processing of a subsequent frame. According to the invention, the decision period of the classifier is on the order of a frame or a predefined number of frames.

FIGS. 4*a* through 6 detail an implementation of an embodiment of the present invention. FIGS. 4*a*, 4*b*, 5*a* and 5*b* illustrate a method of extracting the long-term and short-term features, while a method of applying the features for classification is described with reference to an architectural diagram of the classification module in FIG. 6.

As discussed above, in order to efficiently and accurately classify a signal as speech or music, one or more features are selected and analyzed. This selection, in general, is based on knowledge of the nature of the disparate signal types. Optimally, a feature is selected that essentially characterizes a type of signal, i.e., that presents distinct values for speech and music signals. With respect to some features, the value of the feature at a given point in time is not usable for distinguishing speech from music. However, some such features display a variance from one point in time to another that is usable to distinguish speech from music. That is, a speech signal may yield a much greater, or much lesser, variance in a particular feature than a music signal does. With respect to such features, the feature variance rather than the feature value itself is used for discrimination. Both types of attributes will be referred to as features.

Mathematically, a variance of a function $f$ is defined with respect to a sequence of values of the function $f$ and may be written as:

$$\text{Variance } f(f(1), f(2), f(3), \ldots f(j)) = \frac{1}{j-1}\sum_{k=1}^{J}\left(f(k) - \frac{1}{j}\sum_{l=1}^{j} f(l)\right)^2 \quad \text{(Equation 1)}$$

wherein $f(j)$ represents the $j^{th}$ value of $f$, and the variance $f$ is obtained by analyzing values of $f$ over the range of values for j as indicated. The indices k and l are summation indices in equation 1, and will be eliminated after summation.

Both time domain and frequency domain features may be used for signal differentiation. Frequency domain features employ a transform, such as the standard Fast-Fourier-Transformation (FFT), to convert time-domain signals into the frequency domain. With respect to the frequency domain signal, a set of characterizing features is selected. In an embodiment, the set includes, but is not necessarily limited to (1) the variance of the spectral flux (hereafter, "VSF"), and (2) the variance of the spectral centroid (hereafter, "VSC"). In an embodiment, the set of time domain features further includes, but is not necessarily limited to, (3) the variance of the line spectral frequency pair correlation (VLSP), (4) the signal energy contrast, and (5) an average long-term prediction gain (hereafter, "LTP gain").

Spectral flux is defined as:

$$SF = \frac{|||X_n| - |X_{n-1}|||^2}{\text{Max}(\text{average_energy}, |||X_n| + |X_{n-1}|||^2)} \quad \text{(Equation 2)}$$

wherein n is the index of the nth frame and $X_n$ is the vector representation of the frame n in the frequency domain, which may be written as:

$$\overrightarrow{X_n} = (x_n^0, x_n^1, x_n^2, \ldots x_n^m) \quad \text{(Equation 3)}$$

In Equation 3, $x_n^i$ is the $i^{th}$ complex component of the vector $X_n$ where the value of i runs from 0 to m. The standard FFT technique requires that m+1 is an integer power of two (2). Accordingly, in an embodiment, m is set to 255. This value, as with other specific values, quantities, and numbers given herein, is exemplary and does not limit the invention. The magnitude of the complex vector $X_n$ is defined as:

$$|X_n| = (|x_n^0|, |x_n^1|, |x_n^2|, \ldots |x_n^m|) \quad \text{(Equation 4)}$$

By examining equation 3 with equation 4, it can be seen that the pair of components with 180 degree phase difference produce identical norms. For example, $x_n^1$ and $x_n^{127}$ have the same norm but exhibit 180 degree of phase difference. Thus, $|x_n^1|$ and $|x_n^{127}|$ are identical. Given this fact, equation 4 only has (m+1)/2 different values. In a situation when m is equal to 255, then, equation 4 has only the first 128 valid components that will be used for the following processes.

Combining equations 2, 3, and 4 under an assumption that m in equation 3 equals to 255, $(|X_n|-|X_{n-1}|)^2$ is written as:

$$\||X_n|-|X_{n-1}|\|^2 = \{(|x_n^0|-|x_{n-1}^0|)^2 + (|x_n^1|-|x_{n-1}^1|)^2 + \ldots (|x_n^{127}|-|x_{n-1}^{127}|)^2\} \quad \text{(Equation 5)}$$

Equation 2 includes a normalization function of maximization, Max(average_energy,$\||X_n|+|X_{n-1}|\|^2$), to eliminate dependence of the classification feature on the volume level of the input audio. However, when the input amplitude of the signal is too low, the average energy is used for the normalization, rather than $\||X_n|+|X_{n-1}|\|^2$.

The spectral flux represented by equation 2 shows a high dynamic change in amplitude for speech signals, while remaining relatively smooth in amplitude for music signals. By evaluating this feature over a period of time, the variance of this VSF feature, obtained by applying equation 1, presents distinctive values for speech as opposed to music. That is, the VSF exhibits a high value for speech and a low value for music.

The spectral centroid is defined as:

$$SC = \frac{\sum_{i=0}^{127} i|x_n'|}{\sum_{i=0}^{127} |x_n'|} \quad \text{(Equation 6)}$$

wherein $x_n^i$ is the $i^{th}$ component of the $n^{th}$ frame signal in the frequency domain. It can be shown that for speech signals, the spectral centroid decays quickly with respect to frequency while for music signals the spectral centroid decays more slowly. By examining the spectral centroid over a period of time, the variance of this feature may be obtained with the aid of equation 1. According to the observed decay rates for speech and music, speech signals are expected to show high variance of spectral centroid, while for the music signals, the variance in the spectral centroid is expected to be lower.

Referring to another feature usable to distinguish between speech and music signals, a Line Spectral Frequency pair correlation (LSP) can be calculated by finding the correlation in LSP vectors from consecutive audio frames. LSPs are obtained by using standard Linear-Predictive (LP) analysis. For speech signals, LSPs change more rapidly from one frame to the next. In contrast, for music signals, the flatness of the music spectrum causes smaller changes in LSPs from one frame to the next. Consequently, speech signals have a large dynamic range of the variance of LSP correlation, while music signals have a much smaller dynamic range in the correlation. Since those of skill in the art are familiar with techniques to obtain the LSP correlation, detailed steps and corresponding mathematics will not be discussed herein.

A time-domain feature usable, preferably in conjunction with the other features discussed, to distinguish speech from music is the energy contrast characteristics of a signal. The energy contrast of a signal is obtained by analyzing a selected portion of an audio signal and determining how much contrast in acoustic energy exists across that signal portion. Mathematically, this feature may be obtained by dividing maximum energy by minimum energy in the signal portion, which is shown as follows:

$$\text{Energy Contrast } (EC) = \frac{Energy_{\max}}{Energy_{\min}}. \quad \text{(Equation 7)}$$

Speech signals usually contain quiet frames, or frames having a signal with a relatively low level of acoustic energy, as well as loud frames, or frames having a signal with a relatively high level of acoustic energy. This is generally why speech signals can be expected to have a high energy contrast characteristic. On the other hand, music signals often present high energy for continuous lengths of time, resulting in a relatively lower energy contrast.

To avoid improper contrast analysis, which could happen due to the existence of transitions from a complete silence signal to either music or speech signal, the maximum energy is calculated as the average of several isolated energy peaks. In particular, a mask is used to search for energy peaks. For example, once a point of maximum energy is found, a certain time window around that point is masked to inhabit further search in the immediate neighborhood of the identified maximum, and the process is repeated. The same procedure is applied to determine minimum energy points in the signal. In fact, a speech signal typically has a characteristic energy modulation of approximately 4 Hz, suggesting an average of 4 energy peaks within one second.

Audio signal processing, in general, employs pitch estimation to aid in the compression of the audio signal for storage or transmission. Along with the pitch estimation, a long-term prediction (LTP) gain is typically generated. The LTP gain is found to show a higher value for speech signals, while presenting a lower value for music signals. For example, a musical signal may be generated from the playing of several unrelated musical instruments, each having a different changing frequency. Because of the difference in LTP gain associated with speech signals and music signals, this feature is also useful, preferably in conjunction with the other features described herein, in distinguishing speech from music. Since those of skill in the art are familiar with standard techniques and related mathematical procedures for obtaining the average LTP values for signals, a detailed discussion of LTP derivation or processing will not be set forth herein.

To efficiently and accurately obtain the above described features from the frames, a plurality of functional modules in the feature extractor 220 in FIG. 2 are used as will be discussed hereinafter with reference to FIGS. 4*a* and 4*b*.

Figure 4B:
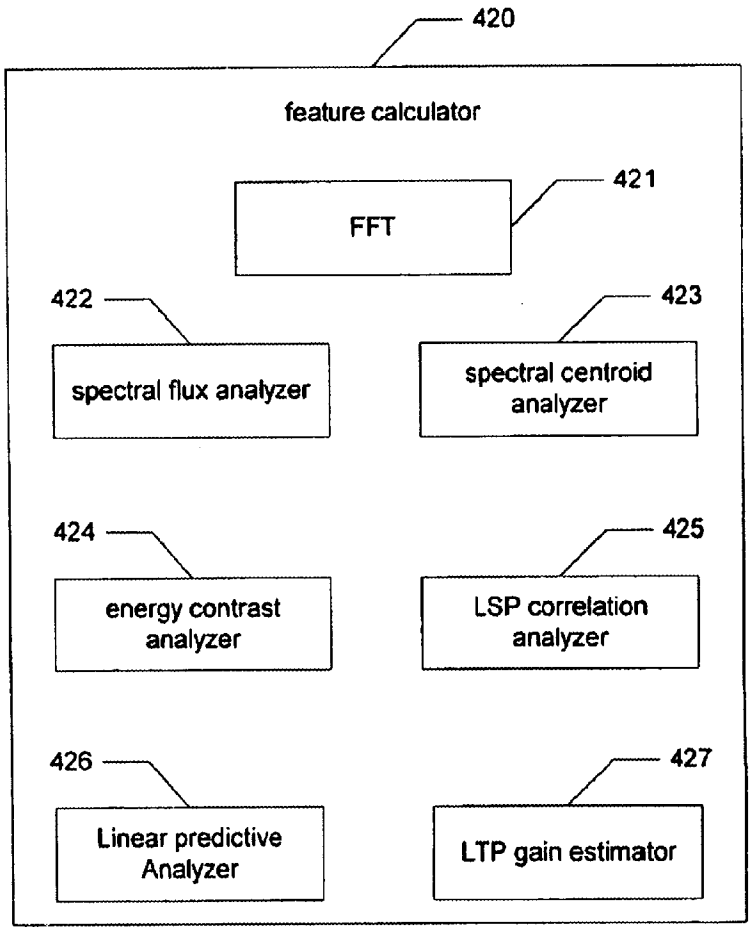
FIGS. 4*a* and 4*b* are structural diagrams associated with a feature extractor module according to an embodiment of the invention.
Figure 4A:
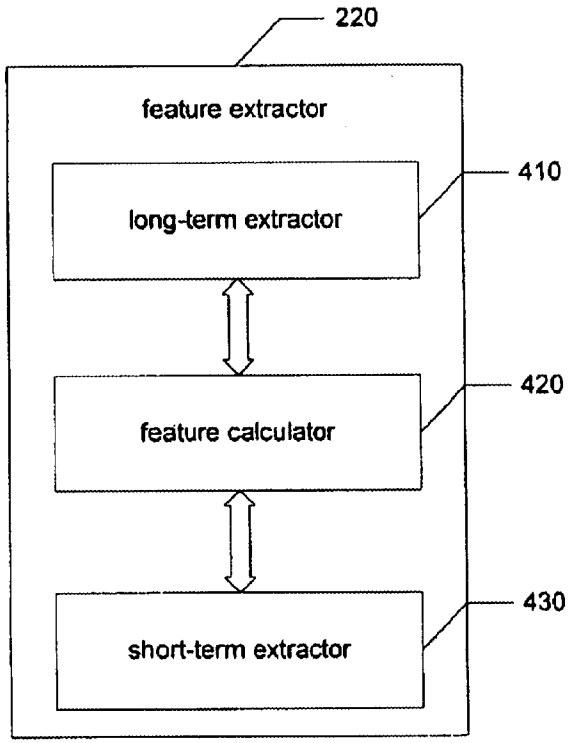

Referring to FIG. 4*a*, an exemplary feature extractor 220 is illustrated, which comprises a feature calculator 420, a long-term extractor 410 in communication with feature calculator 420, and short-term extractor 430 also in communication with feature calculator 420. The feature calculator 420 calculates the selected features according to certain requirements and input parameters, which are specified by long-term extractor 410 and short-term extractor 430, and produces calculated values for the selected features.

One embodiment of the invention employs statistical analysis to a set of frames to extract the selected features of the frame. From a theoretical statistics point of view, the more frames used in the extraction, the more accurate the extracted features will be. Therefore, long-term features, obtained over a longer period of measurement that includes a larger number of frames, are used to provide accurate speech/music classification of the frames. On the other hand, a longer measurement time is not beneficial in determining exact switching points for the operation mode of the coder. In particular, switching requires relatively rapid response and timely prediction. Thus, shorter time measurement, resulting in short-term features, is more effective for calculating switching decisions.

Long-term feature values and short-term feature values are calculated for the selected features such as those described above. A typical time window for measuring a short-term feature is 0.2 second, corresponding to, for example, 10 frames, while for a long-term feature, the typical time window is 1 second, corresponding to, for example, 50 frames, at 20 milliseconds-per-frame. By using both the short-term and long-term feature values for classification and switching time determination, the classifier performs more efficiently and accurately than typical classifiers.

Feature calculator 420 in FIG. 4*a* is comprised of several functional modules that are shown in detail in FIG. 4*b*. Referring FIG. 4*b*, feature calculator 420 comprises a FFT module 421 for transforming a signal from the time domain to the frequency domain and for generating the frequency spectrum of the signal, a spectral flux analyzer 422 for calculating the spectral flux as specified in equation 2 and with reference to the mathematical procedures specified in equations 3 through 5, a spectral centroid analyzer 423 for analyzing the spectral centroid described in equation 6, an energy contrast analyzer 424 for estimating the energy contrast defined in equation 7, a LSP correlation analyzer for obtaining the LSP correlations of the signal, a Linear Predictive analyzer 426 for performing standard LP analysis, and an LTP gain estimator 427 for calculating the LTP gains according to a standard procedure. These functional modules estimate corresponding features from the frames recorded in the look-ahead buffer.

Figure 5A:
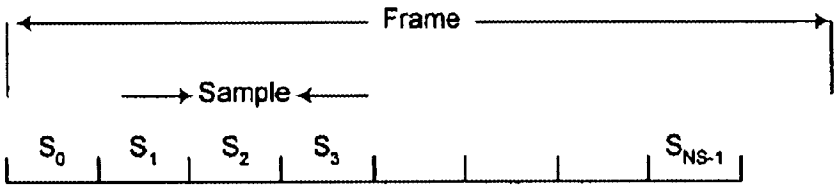
FIGS. 5*a* and 5*b* are signal plots that show the frame structure and look-ahead buffer structure according to an embodiment of the invention.
Figure 5B:
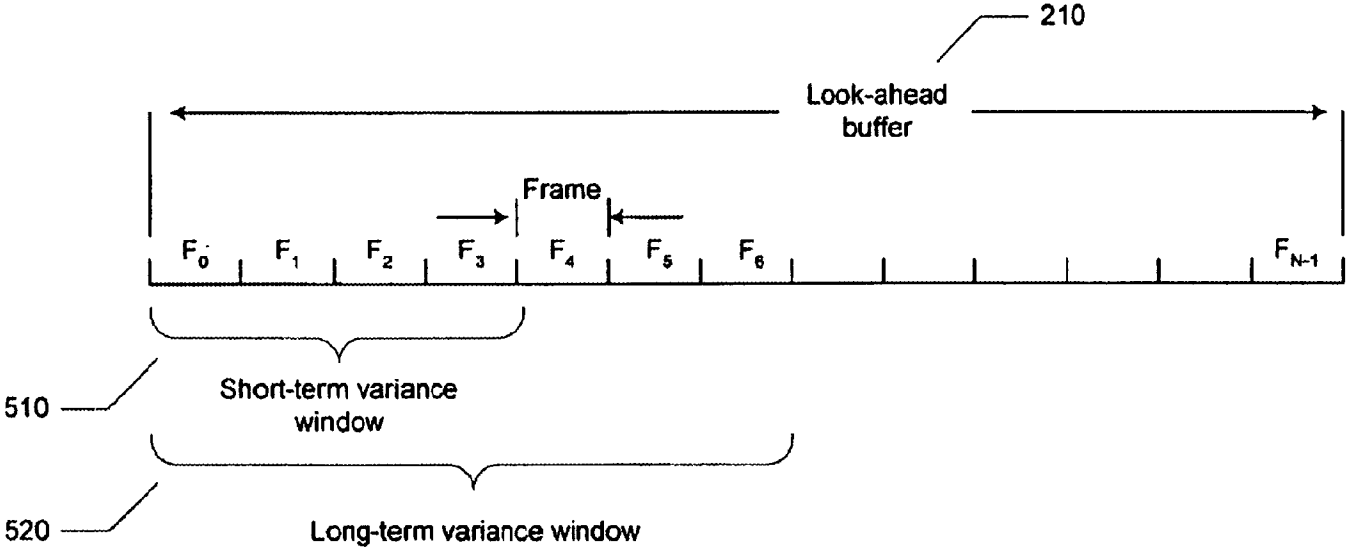

FIGS. 5*a* and 5*b* demonstrate an exemplary structure of a frame and of a series of frames recorded in the look-ahead buffer respectively. Referring to FIG. 5*a*, a typical input frame of an audio signal is composed of a sequence of samples such as, $s_0, s_1, s_2, \ldots s_{NS-1}$, wherein the subscript NS indicates the number of samples in the frame. An exemplary value of NS is 256. Frame length is preferably 20 ms, corresponding to a sample of 78 microseconds in duration.

Referring to FIG. 5*b*, look-ahead buffer 210 comprises a sequence of N frames. A typical length of the buffer is 1.5 seconds. As previously discussed and illustrated, calculation of short-term features is performed with respect to a short-term window 510 that is shorter than long-term window 520. Variance of a feature value is calculated over all the frames included in the window. A typical short-term window is 0.2 second and a typical long-term window is 1 second. Note that for clarity of exposition, the window sizes in FIG. 5*b* are not shown at exact size.

Given the estimated long-term and short-term features, the classification module 230 detects potential switching locations based on short-term features, and makes a final switching decision by classifying each frame using the long-term features and a predefined criterion, which will be discussed hereinafter.

Figure 6:
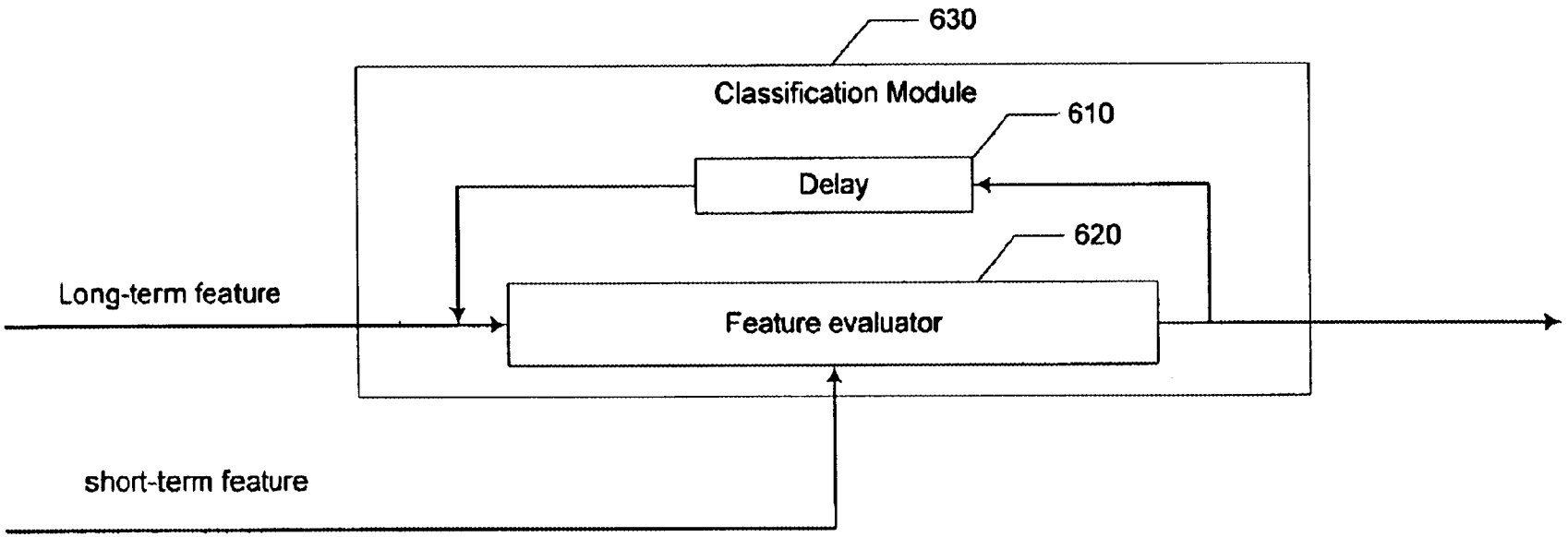
FIG. 6 is an architectural diagram showing the structure of a classification module according to an embodiment of the invention.

Those of skill in the art will appreciate that as used herein, the term "feature" can be used to describe feature values as well as feature variances. Referring to FIG. 6, a classification module 630 comprises a feature evaluator 620 and a delay module 610. The feature evaluator 620 receives long-term features and short-term features from a feature extractor such as feature extractor 220 in FIG. 2, detects potential switches according to the short-term features, makes switch decisions by classifying each frame according to the long-term features and a predefined criterion, and switches the operation mode of the coder based on the decision made. Delay module 610 functions to help avoid unnecessary switching of the encoding mode.

One embodiment of the invention will be discussed with reference to FIGS. 7–9 in the following while an alternative embodiment will be discussed with reference to FIGS. 10–11. Those of skill in the art will appreciate that certain features of one embodiment will be usable within another embodiment and vice versa without departing form the scope of the invention.

Figure 7:
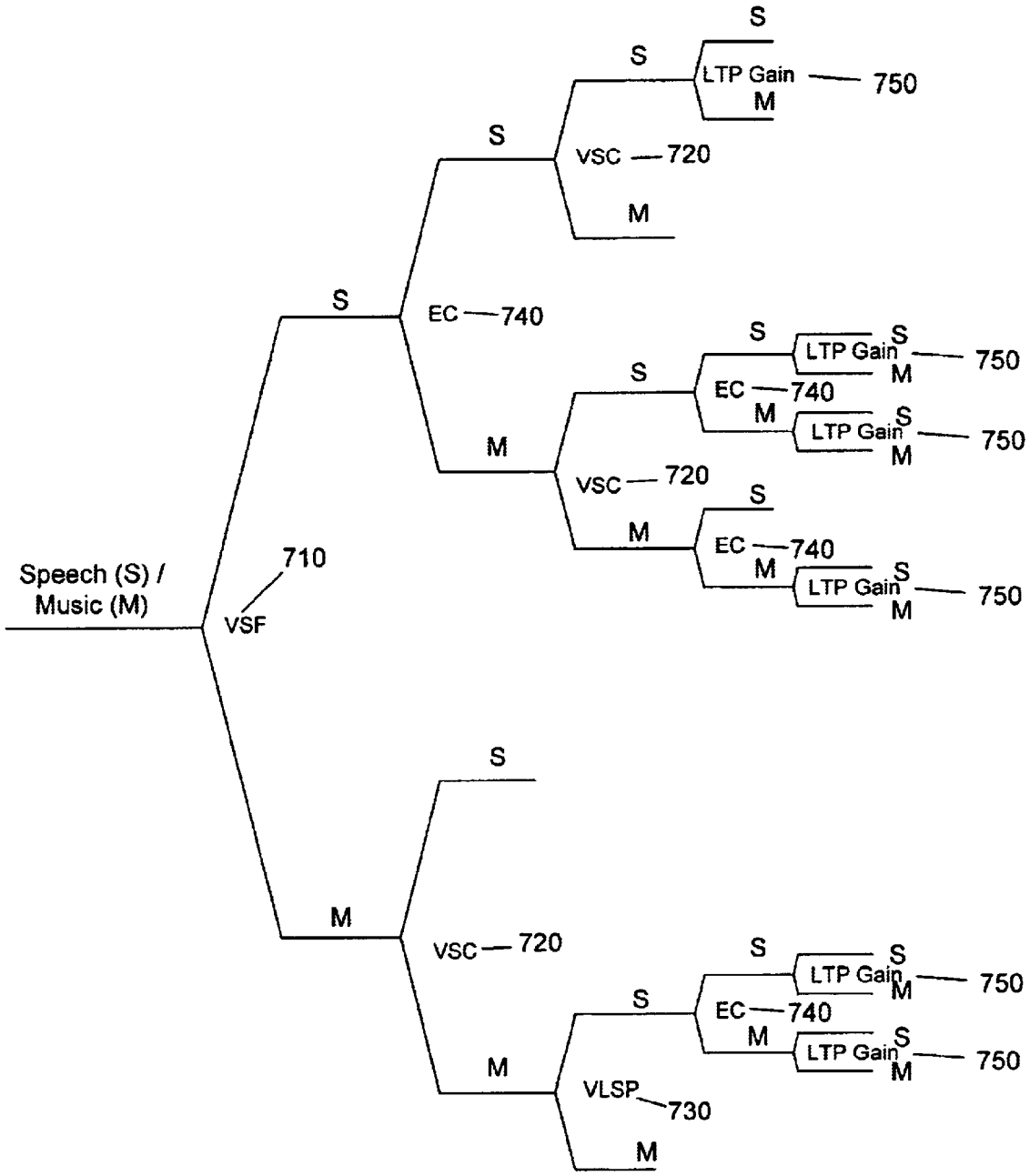
FIG. 7 illustrates an exemplary decision tree implemented in an embodiment of the invention.

According to one embodiment of the invention, given the extracted features, frames are classified through the use of the decision tree technique as shown in FIG. 7. The decision tree of FIG. 7 illustrates the case when the extracted features include the variance of spectral flux (VSF) 710, variance of spectral centroid (VSC) 720, variance of line spectral frequency pair correlation (VSLP) 730, energy contrast (EC) 740, and Long-term prediction gain (LTP gain) 750. The decision tree technique applies these features as decision nodes as indicated by the placement of the numbered features. The features are sorted according to their importance to the decision, such that the feature of greatest significance along a path is assigned to the very first decision node, the feature of the second most significance is assigned to the second decision node, and so on until all features are assigned to a node. The tested feature at each level of the tree is the feature most relevant to the classification at that part of the tree. Accordingly, such decision trees are usually optimized for best classification performance using a training procedure, or any ad-hoc technique. The tree may be non-symmetric, as shown, and the depth of each branch of the tree is defined by design.

Figure 8A:
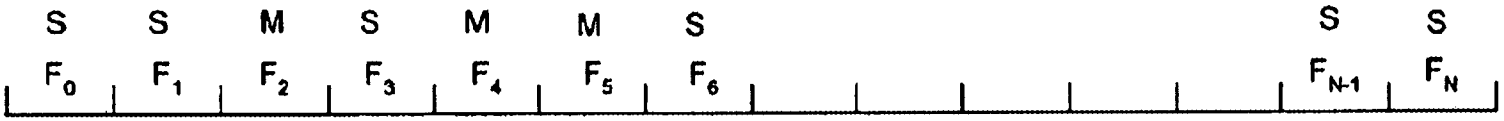
FIGS. 8*a* and 8*b* are diagrams showing a method of determining a switching location according to an embodiment of the invention.

For an as yet unclassified audio signal, the node of VSF 710 first statistically classifies the signal into either a speech or a music based on the VSF feature of the signal. At the node of VSC 720, the signal is further classified according to the VSC feature of the signal, resulting in either a speech or music interim decision. At the node of VLSP 730, the signal is further classified according to the VLSP feature of the signal, which gives either a speech or a music interim classification. Similarly, at the node of EC 740, the signal experiences classification based on the EC feature of the signal, thus, either a speech or a music signal is suggested. Finally, at the node LTP gain 750, the signal is determined to be either a speech or a music signal according to the LTP gain feature of the signal, therefore, a final decision is achieved. Each of the frames in the look-ahead buffer is classified accordingly as shown in FIG. 8*a*. In particular, a sequence of frames $F_0, F_1, F_2, \ldots F_{N-1}, F_N$ in the buffer is classified as a sequence of speech and music signals, S, S, M, S, M, M, S, . . . S, S, wherein S denotes a speech signal frame and M denotes a music signal frame. Each of the classified frames is then used to determine whether to switch the encoding mode of the encoder in a manner described hereinafter with respect to FIG. 8*b*.

Figure 8B:
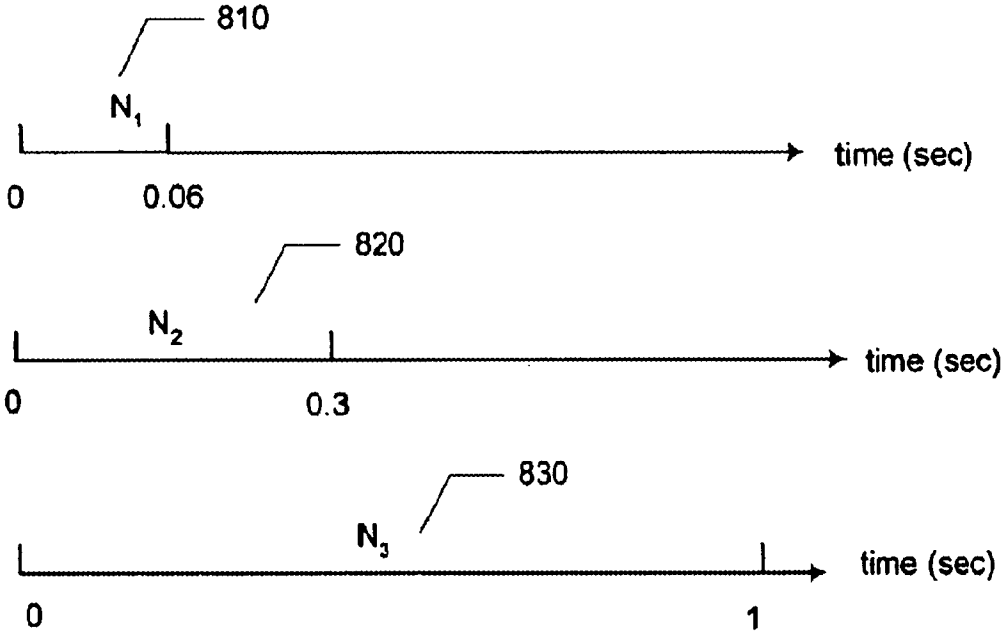

Referring to FIG. 8*b*, three switching-test windows, represented by windows N1 810, N2 820, and N3 830 respectively, are arranged in an overlapping manner. The windows all start at the position of a detected potential switch, represented by time zero (0). Exemplary lengths are 1 sec, 0.3 sec, and 0.06 sec. Although the present invention employs three overlapping switching-test windows, this should not be taken as a limitation. For example, any number of test windows may be used and the size of the windows may be defined according to, for example, the user's preferences.

In an embodiment of the invention, the switching criterion is that: a) in a switching-test window, an indication of switching is generated only when the number of the frames of one class overwhelms the number of the frames of another class (for example, 70% of all the frames in one switching-test window are speech frames) and the overwhelming class does not match the on-going operation mode of the coder (for example, the overwhelming class is speech frames, while the coder is currently working in the music coding mode); and b) only when all three switching-test windows yield the same switching indication is a switching decision made for the frame. In this way, a certain amount of hysteresis is introduced to prevent excessive switching and resultant artifacts in the reproduced signal. The presence of more than one window helps ensure that when a switch is indicated, that the frames causing the switch are closer to the switch location than they are to the end of the long window.

Note that in an embodiment, constraint (b) is relaxed so that a switching decision is made even when less than all of the switching-test windows yield the same switching indication. The constraint (b) in this embodiment is that only when a predetermined number or proportion of the switching test windows yield the same switching indication is a switching decision made for the frame. The predetermined proportion in an embodiment is a simple majority of the switching test windows, while in another embodiment, the proportion is approximately two-thirds of the switching test windows. Any other proportion, be it greater than or less than a majority may equivalently be used. As discussed, the threshold may equivalently be a number rather than a proportion. In a system using three switching test windows, the number could be two. In a system using ten such windows, the number may be six. Any other number greater than or equal to one and less than or equal to the total number of switching test windows may equivalently be used.

Figure 9:
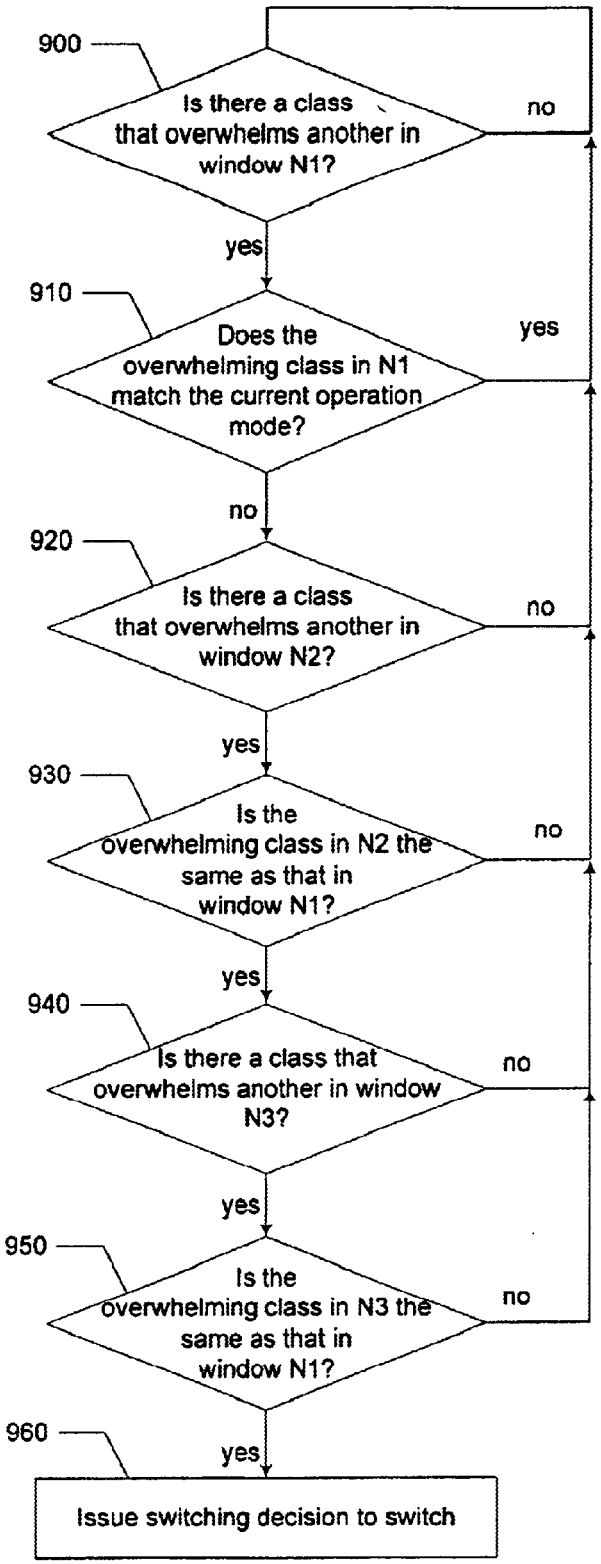
FIG. 9 is a flow chart presenting the steps executed in a method according to an embodiment of the invention such as that described in FIGS. 8*a* and 8*b;*

A flow chart corresponding to the criterion described above is illustrated with respect to one embodiment in FIG. 9. Starting from step 900, it is determined whether one class of frames overwhelms another class in window N1. If so, at step 910, it is determined whether the overwhelming class in N1 matches the current operation mode. For example, assuming that in N1 it is found that 70% of all frames are speech frames, then the overwhelming class in N1 at step 900 is determined as speech class. Then at step 910, the current operation mode of the coder is checked and is found to be music mode. Since the speech class as the overwhelming class in N1 determined at step 900 does not match the current operation mode, the music mode, then step 910 yields "no" and is followed by step 920. At step 920, it is determined whether one class of frames overwhelms another class in window N2. If so, at step 930, it is determined whether the overwhelming class in window N2 is the same as the overwhelming class in window N1. If so, at step 940, it is further determined whether one class of frames in window N3 overwhelms another class. If so, at step 950, it is finally decided whether the overwhelming class in window N3 is the same as the overwhelming class in N1. If so, at step 960 a decision is made to switch the mode of operation of the coder.

If a decision to switch is made, the switch occurs at the time defined by the short-term features, taking advantage of the fact that short-term features are obtained in a relatively shorter period of time, and thus may position the time of switch more precisely. As a result, the coder changes its operation mode according to the long-term features of the frame, at a time determined with respect to the short-term features upon receiving a switching decision based on the predefined criterion.

According to another embodiment of the invention, long-term and short-term features are extracted from each of the frames recorded in the look-ahead buffer. Unlike the classification method described in the first embodiment, the classification of each frame may be accomplished by statistically analyzing the features of all frames in the buffer. In particular, the classification method applies a standard pattern recognition technique. For doing this, a feature space is constructed with the selected features. Each frame is then described by a point in the feature space. Because of the different nature of the signals, resulting in distinct values of the features, the points, each of which represents a frame of a class, in the feature space form a certain pattern. For example, points of similar features are close to each other. Points of dissimilar features are distant from each other. Thus, it is expected that points of speech class form a group that is separate from the group composed of points of music class. Mathematically, standard pattern recognition techniques are applied to automatically distinguish the separate patterns in the feature space, thus, enabling a determination of the likely classification of a frame corresponding to a particular point.

Figure 10:
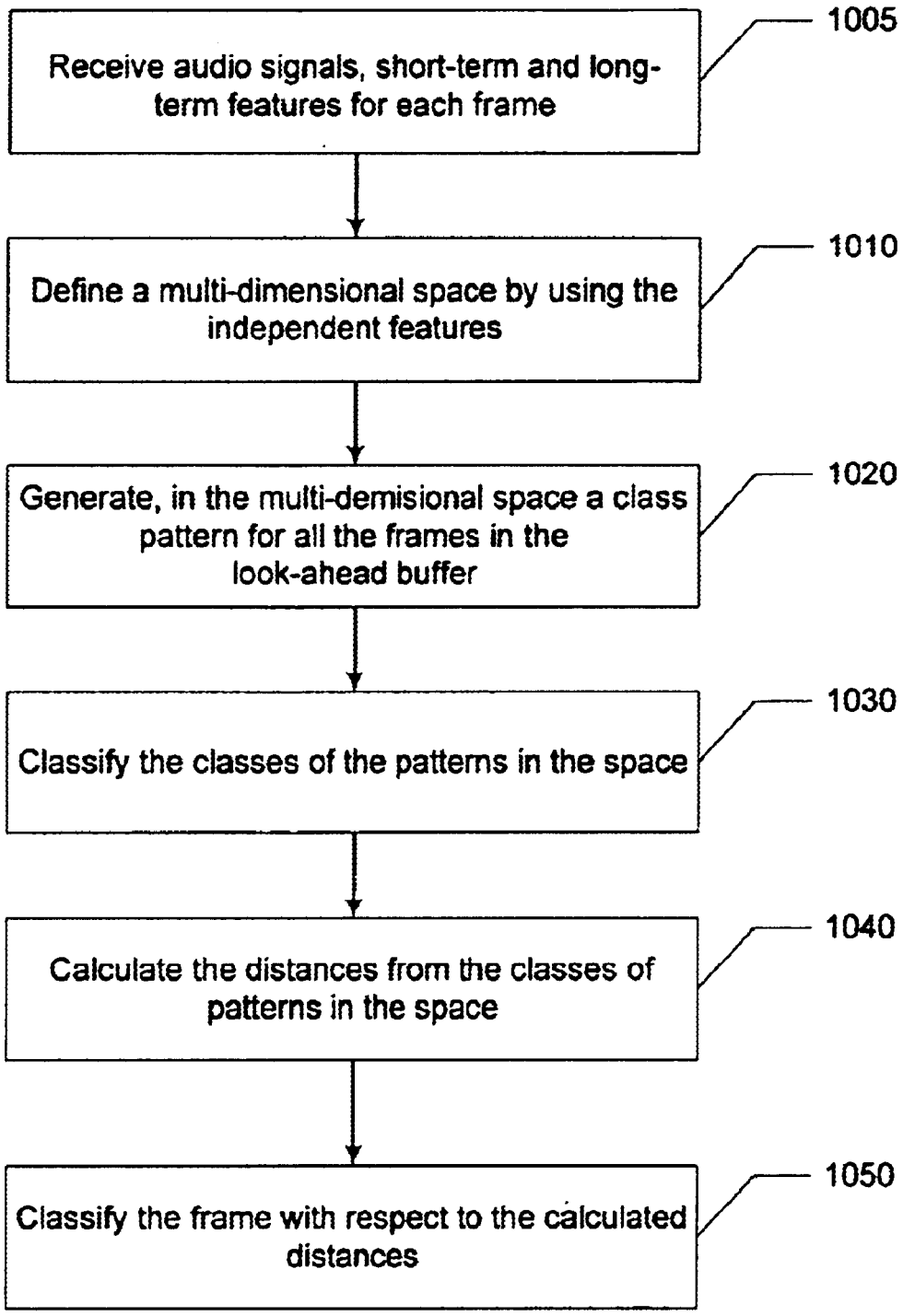
FIG. 10 is a flow chart describing the steps executed in classifying a sequence of speech and music signals according to an embodiment of the invention.

Referring to FIG. 10, a flow chart illustrates this alternative embodiment of the invention. Given extracted short-term and long-term features for each frame at step 1005, at step 1010, a multi-dimensional space is defined using the selected features. For the frames in the buffer, each frame is represented by a point in the feature space at step 1020 based on the extracted long-term features. Thus, the frames in the buffer are represented by a certain pattern in the feature space. At step 1030, the pattern in the feature space is then recognized utilizing any one of a number of standard pattern recognition techniques. At step 1040, the distance of a point corresponding to a frame from the recognized patterns in the feature space is calculated. At step 1050, the frame is classified with respect to the calculated distances. In the following, a detailed example will be discussed.

Assuming that the selected features include VSF, VSC, VLSP, EC, and LTP gain, the feature space may be defined by these features and a point in the space may be presented as: F(VSF, VSC, VLSP, EC, LTP gain). F represents a frame having the long-term features of VSF, VSC, VLSP, EC, and LTP gain. By presenting all frames in the buffer in the feature space, a certain pattern will be formed. Because the speech and music are intrinsically very different signals, the values of the features present quite different values for the two types of signals. Therefore, the points representing the speech frames in the feature space are expected to be relatively distant from the points representing the music signals. That is, speech points form a group, while music points form another group that is substantially separate from the speech group.

Mathematically, each group in the feature space is described by a centroid vector, denoted by m. The classification of a frame is then accomplished by measuring the distances of the frame point to the separate patterns in the feature space and making the classification decision based on the measured distances using a likelihood function mathematically. For example, the distance is measured by:

$$d_{speech}^2=(x-m_{speech})^T C_{speech}^{-1}(x-m_{speech}) \text{ and}$$

$$d_{music}^2=(x-m_{music})^T C_{music}^{-1}(x-m_{music}) \quad \text{(Equation 8)}$$

wherein $m_{speech}$ and $m_{music}$ are centroids of the speech pattern and music pattern in the feature space, respectively. The quantities $(x-m_{speech})^T$ and $(x-m_{music})^T$ denote the transpositions of the vectors $(x-m_{speech})$ and $(x-m_{music})$, respectively. C is the covariance matrix and x is a vector that represents the features of the to-be-classified frame. The speech and music patterns are assumed to conform to Gaussian distributions. The quantity $d^2$ reflects the weighted square distances from the frame to the speech and music patterns in the feature space and is used to define a likelihood function $f$ as follows:

$$f(d_{speech}, d_{music}) = \begin{cases} d_{music}/d_{speech} - 1, & \text{if } d_{music} > d_{speech} \\ -(d_{speech}/d_{music}) + 1, & \text{if } d_{music} < d_{speech} \end{cases} \quad \text{(Equation 9)}$$

The likelihood function $f$ is used to generate a likelihood profile for each frame in the look-ahead buffer. A classification is made by measuring the likelihood function. For example, if $f$ yields a positive value, the frame is classified as a speech frame. Otherwise, the frame is classified as a music frame.

For each of the classified frames, the execution and placement in time of the switching decision will be performed afterwards, in a manner similar to the techniques and procedures described with respect to the preceding embodiment. Hence, such procedures will not be described again at this point.

Figures 11A, 11B, 11C:
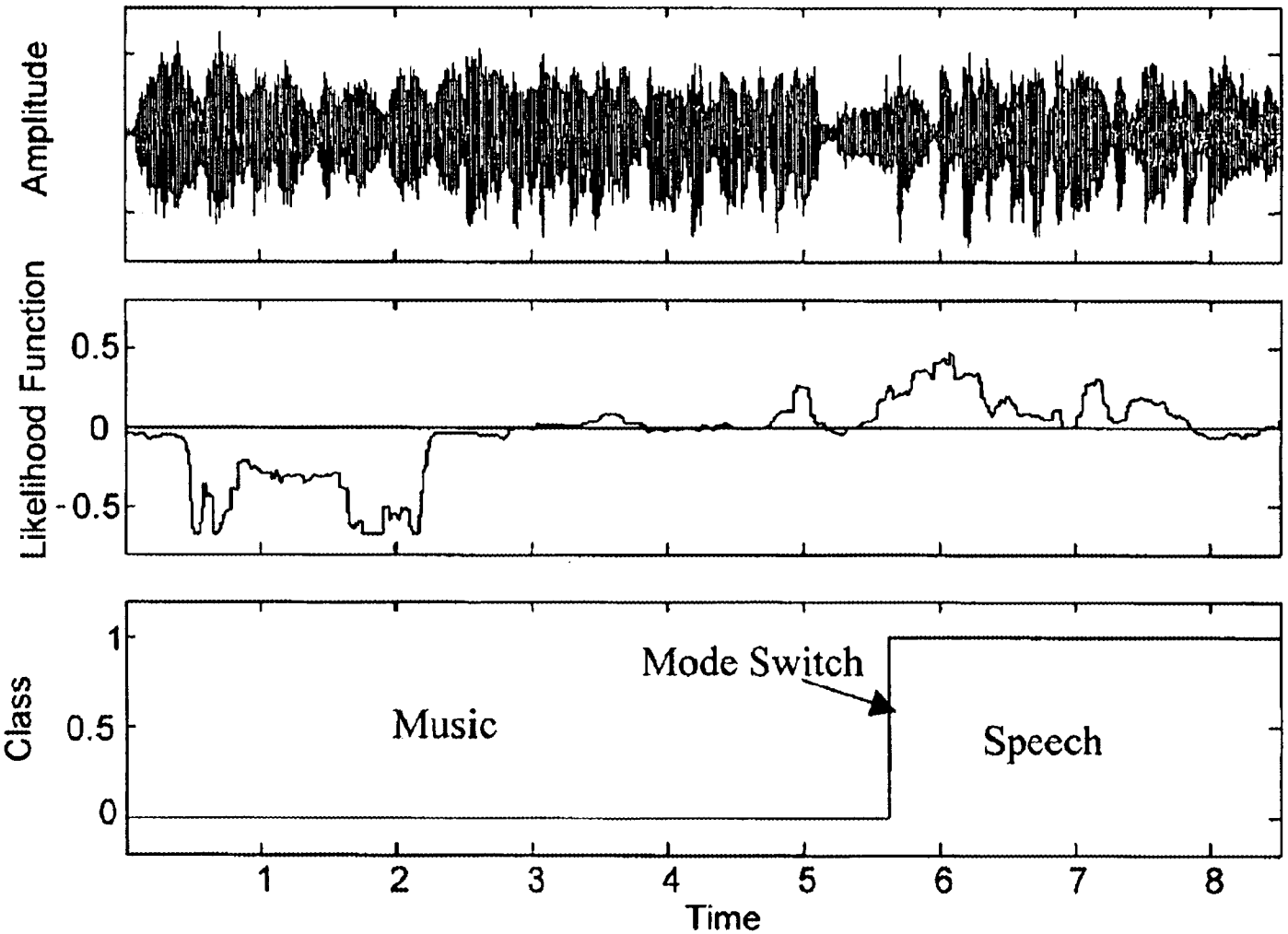
FIGS. 11*a*, 11*b* and 11*c* are timing diagrams illustrating an audio signal, calculated likelihood function, and classification decisions in an embodiment of the invention.

Referring to FIGS. 11*a*, 11*b*, and 11*c*, exemplary results from a measurement according to the above-described alternative embodiment of the invention are illustrated. FIG. 11*a* shows the amplitudes of a sequence of audio signals as a function of time. The audio signals comprise speech and music signals. FIG. 11*b* quantifies the likelihood function, as it varies with time, for the audio signals. The likelihood function of FIG. 11*b* is obtained as described above. It will be seen that FIG. 11*b* shows three distinct regions in time. In particular, before approximately 2.3 seconds, the likelihood function is negative, giving a strong indication of music. Between approximately 2.3 seconds and 5.3 seconds, the likelihood function shows a smooth profile with several peaks. This regime is not clearly dominated by speech or music. Above approximately 5.3 seconds, the likelihood function is positive, giving a strong indication of speech.

FIG. 11*c* depicts the classification results under an assumption that the operation mode of the coder at time zero (the beginning of this measurement) is music mode. With reference to FIG. 11*b*, below approximately 2.3 seconds, the likelihood function suggests a music mode, but since the current mode is music, there is no switch in mode. Between approximately 2.3 seconds and 5.3 seconds, the likelihood function presents weak values with several positive peaks. For the segment of this weak likelihood, the corresponding parameters suggest neither speech mode nor music mode, which may be treated as noisy background signals. For the several positive peak signals, the corresponding parameters may indicate a requirement of speech mode. But in making a final switch decision by applying the three testing windows, the indications will not result in a real switch from the current music mode to a speech mode. Therefore, in this region, no switch is performed, even though part of the likelihood function shows positive values and several peaks. In this way, excessive switching is successfully and efficiently avoided. After approximately 5.3 seconds, the likelihood function shows predominantly strong positive values, and correspondingly, the coder switches its operation mode from music to speech. In this way, the coder changes its operation mode with respect to the statistical results of the frames, and the change is precisely made while avoiding unnecessary frequent switching.

Figure 12:
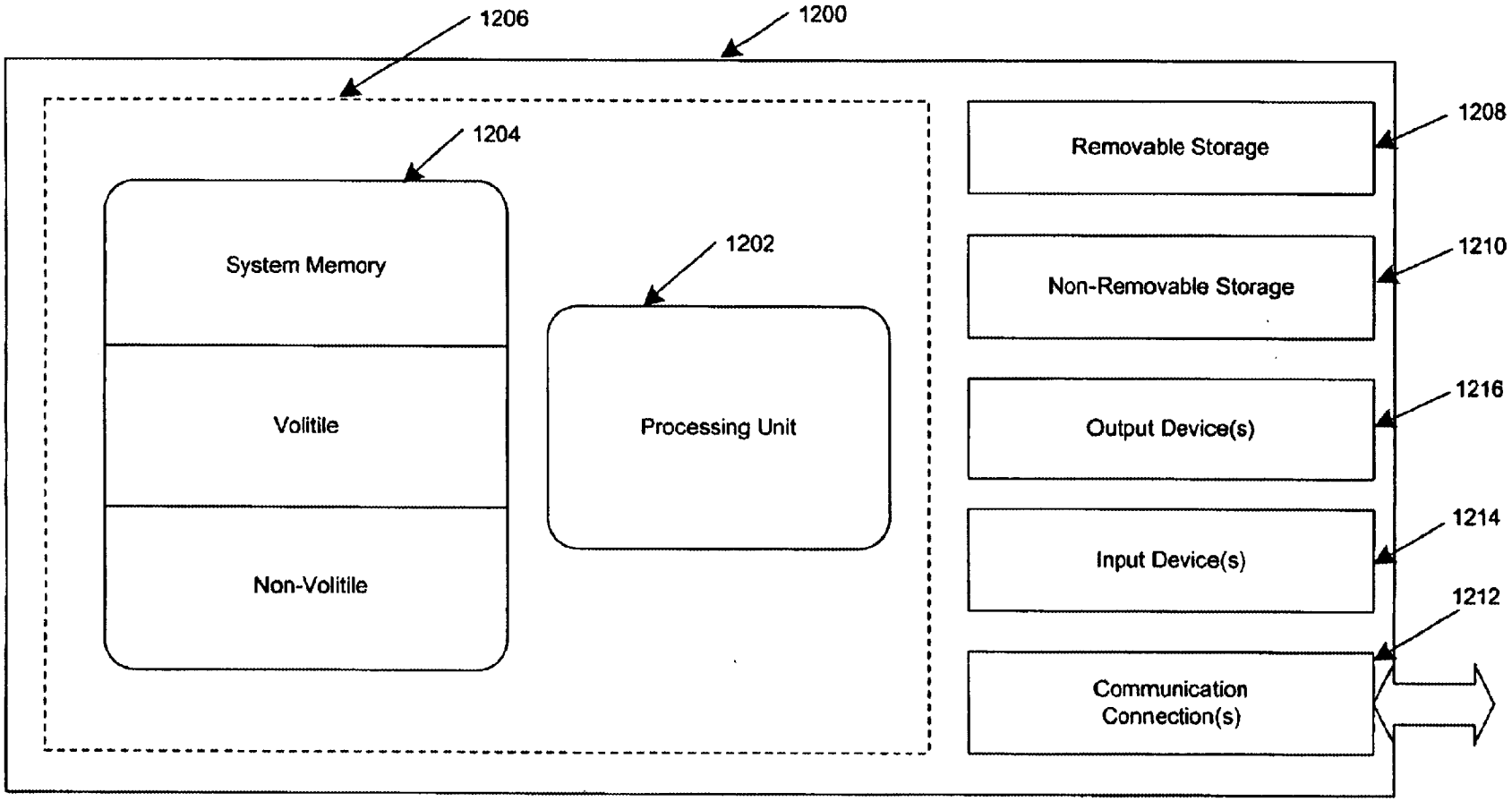
FIG. 12 is a schematic diagram illustrating a computing device architecture employed by a computing device upon which an embodiment of the invention may be executed.

With reference to FIG. 12, one exemplary system for implementing embodiments of the invention includes a computing device, such as computing device 1200. In its most basic configuration, computing device 1200 typically includes at least one processing unit 1202 and memory 1204. Depending on the exact configuration and type of computing device, memory 1204 may be volatile (such as RAM), non-volatile (such as ROM, flash memory, etc.) or some combination of the two. This most basic configuration is illustrated in FIG. 12 by line 1206. Additionally, device 1200 may also have other features/functionality. For example, device 1200 may also include additional storage (removable and/or non-removable) including, but not limited to, magnetic or optical disks or tape. Such additional storage is illustrated in FIG. 12 by removable storage 1208 and non-removable storage 1210. Computer storage media includes volatile and nonvolatile, removable and non-removable media implemented in any method or technology for storage of information such as computer readable instructions, data structures, program modules or other data. Memory 1204, removable storage 1208 and non-removable storage 1210 are all examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can accessed by device 1200. Any such computer storage media may be part of device 1200.

Device 1200 preferably also contains one or more communications connections 1212 that allow the device to communicate with other devices. Communications connections 1212 are an example of communication media. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. As discussed above, the term computer readable media as used herein includes both storage media and communication media.

Device 1200 may also have one or more input devices 1214 such as keyboard, mouse, pen, voice input device, touch input device, etc. One or more output devices 1216 such as a display, speakers, printer, etc. may also be included. All these devices are well known in the art and need not be discussed at greater length here.

It will be appreciated by those of skill in the art that a new and useful method and system of performing classification of speech and music signals have been described herein. In view of the many possible embodiments to which the principles of this invention may be applied, however, it should be recognized that the embodiments described herein with respect to the drawing figures are meant to be illustrative only and should not be taken as limiting the scope of invention. For example, those of skill in the art will recognize that the illustrated embodiments can be modified in arrangement and detail without departing from the spirit of the invention. Thus, for example, although the preceding discussion references a system of using long-term and short-term features, the system may be used with only long-term or only short-term features. In this case, the switching decision is both accurately located and accurately made using the same type of feature, rather than using one type to identify the switching location and another to generate the decision whether to switch. Similarly, those of skill in the art will appreciate that the ordering of the steps of the invention may be altered within the scope of the invention. For example, long-term features may be used first to determine that a switch should be made, after which the short-term features are used to more precisely determine where the switch should occur.

Furthermore, although the invention is described in terms of software modules or components, those skilled in the art will recognize that such may be equivalently replaced by hardware components. Therefore, the invention as described herein contemplates all such embodiments as may come within the scope of the following claims and equivalents thereof.

What is claimed is:

1. A method of classifying a current coding frame in a sequence of audio data frames including the current frame and at least one subsequent frame in real-time for switching a multi-mode audio coding system operated in a current coding mode between different modes, the method comprising:

recording the sequence of audio data frames, including the current frame and the at least one subsequent frame;

extracting at least one long-term feature and at least one short-term feature relative to each of the current frame and the at least one subsequent frame, wherein the features substantially exhibit distinct values for different signal types;

detecting a potential switch point according to the at least one short-term feature of the current frame and the current coding mode; and determining whether to switch the current coding mode of the coding system at the potential switch point based on the at least one long-term feature.

2. The method of claim 1, wherein the step of determining further comprises the step of classifying the audio data frames in the recorded sequence of audio data frames as speech or music based, at least in part, on the at least one long-term feature.

3. The method of claim 2, wherein the at least one long-term feature comprises a plurality of long term features, and wherein the step of classifying the audio data frame comprises the step of traversing a decision tree wherein the plurality of long-term features are represented by nodes.

4. The method of claim 1, wherein the at least one long-term feature is a variance of an audio data parameter selected from the group consisting of spectral flux, spectral centroid, line spectral frequency pair correlation, and long-term prediction gain.

5. The method of claim 1, wherein the step of determining whether to switch further comprises the steps of:

defining a switching-test window;

analyzing a classified sequence of frames in the window to generate a determination whether to switch; and if a determination to switch is generated, generating a switching instruction.

6. The method of claim 5, wherein the determination to switch in a switching-tests window is made when:

one data type overwhelms another data type in the window; and the overwhelming data type does not correspond with the current coding mode.

7. The method of claim 1, wherein the step of determining whether to switch further comprises the steps of:

defining a plurality of overlapping switching-test windows;

analyzing a classified sequence of frames in each switching-test window to make a determination whether to switch for each switching-test window; and if a determination to switch is made in a predefined portion of switching-test windows, generating a switching instruction.

8. The method of claim 7, wherein the determination to switch in a switching-test window is made when:

one data type overwhelms another data type in the window; and the overwhelming data type does not correspond with the current coding mode.

9. The method according to claim 7, wherein the predefined portion comprises all of the plurality of switching test windows.

10. A computer-readable medium having computer-executable instructions for performing the method of claim 1.

11. A method for switching an audio encoder between a speech mode and a music mode for coding a sequence of audio data frames including the current frame and at least one subsequent frame, the method comprising:

recording the sequence of frames, including the current frame and the at least one subsequent frame, in a buffer;

extracting at least one long-term feature and at least one short-term feature relative to each of the current frame and the at least one subsequent frame, wherein the features substantially exhibit distinct values for speech and music frames;

detecting a potential switch point according to the at least one short-term feature extracted from each of the current frame and the at least one subsequent frame;

defining a feature space by the at least one long-term feature of each of the current frame and the at least one subsequent frame;

generating a feature point in the feature space for each frame in the buffer, wherein a set of feature points defines a feature pattern;

classifying each of the current frame and the at least one subsequent frame via pattern recognition relative to the feature pattern; and determining whether to switch the mode of the audio encoder according to the classification and a predefined switching criterion.

12. The method of claim 11, wherein the pattern recognition method comprises the steps of:

calculating a separate Mahalanobis distance value from the feature point of each frame to the center of a speech frame feature pattern and the center of a music frame feature pattern;

calculating a likelihood value of each frame based on the Mahalanobis distance value for the frame; and classifying each frame based, at least in part, on its calculated likelihood value.

13. The method of claim 12, further comprising the step of calculating a separate Euclidean distance in the feature space.

14. A coder system for coding a sequence of audio frames composed of speech data frames and music data frames including the current frame and at least one subsequent frame, the coder system comprising:

an encoder having multiple operating modes, at least one of which is for encoding speech data and another of which is for encoding music data; and an encoding classifier in communication with the encoder, wherein the encoding classifier is adapted for determining a potential switching time for the encoder to switch its operating mode based on one or more extracted short-term features of a frame, classifying each frame in the sequence, including the current frame and the at least one subsequent frame, according to one or more long-term features according to a predefined criterion, and providing a set of classification information classifying at least one frame of the frames as a speech data or music data fame.

15. The coder system of claim 14, further comprising:

a decoder of classification information for classifying an encoded frame according to the classification information and providing decoded classification information; and a decoder having multiple modes, one of which is adapted for decoding a speech frame encoded by the encoder and one of which is adapted for decoding a music frame encoded by the encoder, for switching its operating mode according to the classification information provided by the decoder of classification information and decoding a frame classified by the decoded classification information.

16. A method of classifying a current coding frame in a sequence of audio data frames including the current frame and at least one subsequent frame in real-time for switching a multi-mode audio coding system operated in a current coding mode between different modes, the method comprising:

recording the sequence of audio data frames, including the current frame and the at least one subsequent frame;

extracting at least one long-term feature and at least one short-term feature relative to each audio data frame, including the current frame and the at least one subsequent frame, wherein the features substantially exhibit distinct values for different signal types;

determining whether to switch the current coding mode of the coding system based on the at least one extracted long-term feature; and if it is determined to switch the current coding mode of the coding system, detecting a switch point according to the at least one short-term feature of the current frame and the current coding mode, at which to switch the current coding mode of the coding system.

17. A method of classifying a current coding frame in a sequence of audio data frames including the current frame and at least one subsequent frame in real-time for switching a multi-mode audio coding system operated in a current coding mode between different modes, the method comprising:

recording the sequence of audio data frames, including the current frame and the at least one subsequent frame;

extracting at least one long-term feature relative to each audio data frame, including the current frame and the at least one subsequent frame, wherein the at least one feature substantially exhibits distinct values for different signal types;

detecting a potential switch point according to the at least one long-term feature of the current frame and the current coding mode; and determining whether to switch the current coding mode of the coding system at the potential switch point based on the at least one long-term feature.

* * * * *